US008636233B2

(12) United States Patent
Clark et al.

(10) Patent No.: US 8,636,233 B2
(45) Date of Patent: Jan. 28, 2014

(54) LOW PRECIPITATION RATE ROTOR-TYPE SPRINKLER WITH INTERMITTENT STREAM DIFFUSERS

(75) Inventors: Michael L. Clark, San Marcos, CA (US); Daniel E. Hunter, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 174 days.

(21) Appl. No.: 13/051,255

(22) Filed: Mar. 18, 2011

(65) Prior Publication Data

US 2012/0234940 A1 Sep. 20, 2012

(51) Int. Cl.
*B05B 1/30* (2006.01)

(52) U.S. Cl.
USPC ..... 239/581.1; 239/237; 239/240; 239/242; 239/263.3; 239/580; 137/527

(58) Field of Classification Search
USPC ..... 239/237, 240, 242, 263.3, 580, 581.1, 239/583, 538, 540; 137/527, 537; 251/237
See application file for complete search history.

(56) References Cited

U.S. PATENT DOCUMENTS

| | | | | | |
|---|---|---|---|---|---|
| 3,482,603 | A | * | 12/1969 | Outcalt | 137/515.5 |
| 3,817,278 | A | * | 6/1974 | Elliott | 137/527 |
| 4,718,605 | A | | 1/1988 | Hunter | 239/242 |
| 4,913,352 | A | | 4/1990 | Witty et al. | 239/104 |
| 5,090,446 | A | | 2/1992 | Hunter et al. | 137/540 |
| 5,257,646 | A | | 11/1993 | Meyer | 137/505.25 |
| 5,354,234 | A | * | 10/1994 | Arold et al. | 454/69 |
| 5,456,411 | A | | 10/1995 | Scott et al. | 239/73 |
| 5,699,962 | A | | 12/1997 | Scott et al. | 239/73 |
| 5,762,270 | A | | 6/1998 | Kearby et al. | 239/205 |
| 5,779,148 | A | | 7/1998 | Saarem et al. | 239/104 |
| 5,979,863 | A | | 11/1999 | Lousberg | 251/30.02 |
| 6,042,021 | A | | 3/2000 | Clark | 239/205 |
| 6,050,502 | A | | 4/2000 | Clark | 239/237 |
| 6,241,158 | B1 | * | 6/2001 | Clark et al. | 239/1 |
| 6,666,277 | B2 | * | 12/2003 | Reilly | 169/16 |
| 6,997,393 | B1 | | 2/2006 | Angold et al. | 239/205 |
| 7,017,831 | B2 | | 3/2006 | Santiago et al. | 239/222.13 |
| 7,287,711 | B2 | | 10/2007 | Crooks | 239/240 |
| 7,401,622 | B2 | | 7/2008 | Ungerecht | 137/315.04 |
| 2005/0133619 | A1 | * | 6/2005 | Clark | 239/205 |
| 2006/0278727 | A1 | * | 12/2006 | Kah, Jr. | 239/67 |
| 2007/0007364 | A1 | | 1/2007 | Gregory | 239/206 |
| 2007/0119978 | A1 | * | 5/2007 | Wang et al. | 239/242 |
| 2010/0147401 | A1 | | 6/2010 | Gregory | 137/512 |

* cited by examiner

*Primary Examiner* — Jason J Boeckmann
*Assistant Examiner* — Joel Zhou
(74) *Attorney, Agent, or Firm* — Knobbe, Martens, Olson & Bear LLP

(57) ABSTRACT

An irrigation sprinkler includes an outer case and a riser extensible from the outer case by water pressure and normally in a retracted position. A nozzle is rotatably mounted at an upper end of the riser. A turbine is mounted in the riser for rotation by water entering a lower end of the riser. A gear train reduction is mounted in the riser. A gear driven coupling mechanism mounted in the riser couples the gear train reduction and the nozzle. A pressure regulator valve is located inside a nozzle turret of the sprinkler and includes a valve member that is pivotably mounted between the gear train reduction and the nozzle.

18 Claims, 24 Drawing Sheets

LOW PRECIPITATION RATE ROTOR-TYPE SPRINKLER WITH INTERMITTENT STREAM DIFFUSERS

FIELD OF THE INVENTION

The present invention relates to sprinklers used in residential and commercial irrigation for watering turf and landscaping.

BACKGROUND OF THE INVENTION

Many parts of the world lack sufficient rainfall at different times of the year to maintain the health of turf and landscaping. Irrigation systems are therefore used to deliver water to such vegetation from municipal water supplies and wells according to a watering schedule. A typical irrigation system comprises a programmable electronic controller that turns valves ON and OFF to deliver water through a plurality of sprinklers connected to the valves via subterranean pipes. These sprinklers are usually rotor-type, impact, spray or rotary-stream sprinklers. Pressure regulators have been installed in residential and commercial irrigation systems externally of the sprinklers. U.S. Pat. No. 5,257,646 of Meyer discloses an in-line pressure regulator for an irrigation system. Pressure regulators have also been incorporated into the sprinklers themselves. U.S. Pat. No. 5,779,148 of Saarem et al. discloses a spray sprinkler with a pressure regulator in its extensible riser. Published U.S. Patent Application No. 2007/0007364 of Gregory discloses a rotor-type sprinkler with a pressure regulator located at the lower end of the riser below the turbine.

SUMMARY OF THE INVENTION

In accordance with the present invention an irrigation sprinkler includes a riser and a nozzle rotatably mounted at an upper end of the riser. A turbine is mounted in the riser and is rotatable by water entering a lower end of the riser. A gear train reduction is mounted in the riser and a coupling mechanism operatively couples the gear train reduction and the nozzle. A pressure regulator valve includes a pivotable valve member that is mounted between the gear train reduction and the nozzle.

DETAILED DESCRIPTION

Figure 1:
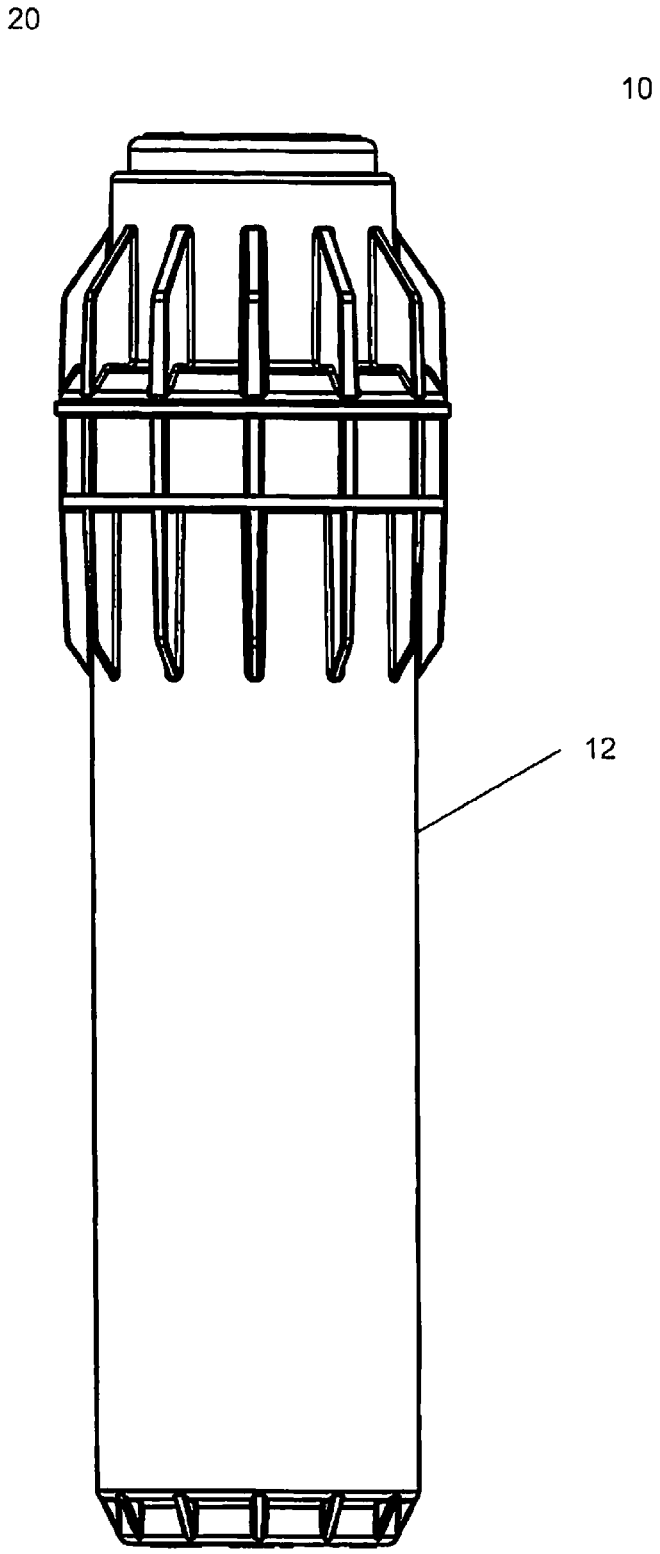
FIG. 1 is side elevation view of a rotor-type sprinkler incorporating a first embodiment of the present invention.
Figure 2:
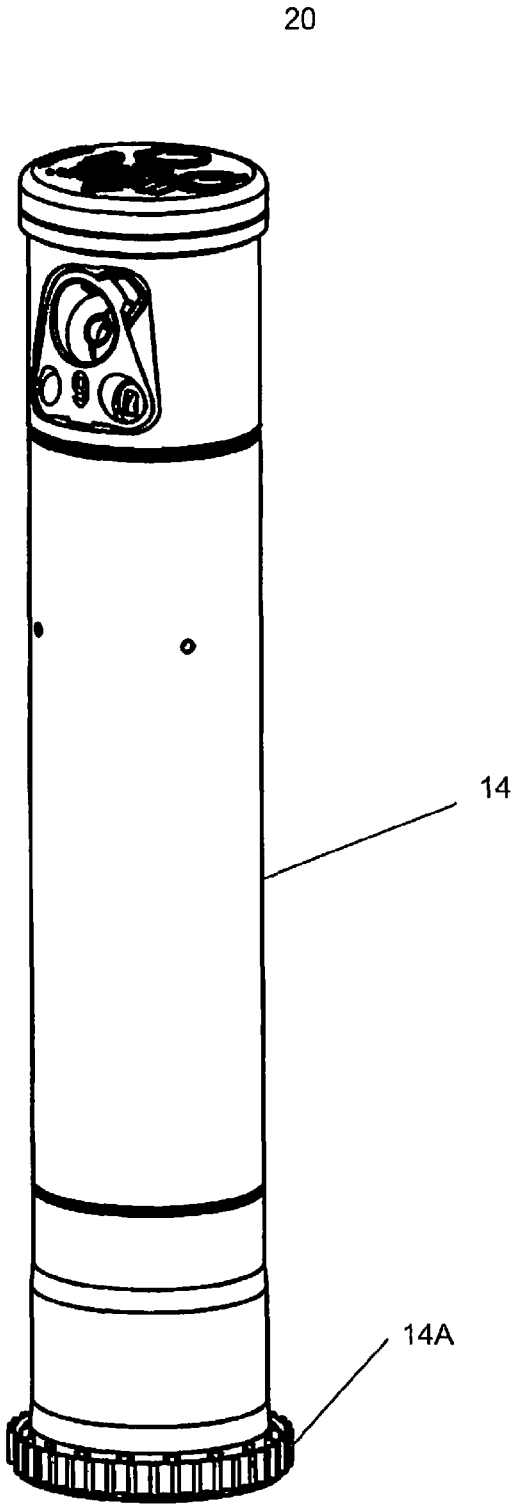
FIG. 2 is an isometric view of the riser portion of the sprinkler of FIG. 1 including its nozzle turret.

Referring to FIG. 1, a pop-up rotor type irrigation sprinkler 10 is made of injection molded plastic parts, metal shafts, steel springs and seals made of a suitable elastomeric material. The sprinkler 10 includes a cylindrical outer case 12 and a rotating turret 20 mounted to the top of a tubular riser 14 (FIG. 2) that is telescopically extensible from the outer case 12 by water pressure. The riser 14 is illustrated in a lowered retracted position in FIGS. 1 and 3. A rotatable cylindrical nozzle turret 20 is mounted at the top of the tubular riser 14.

Figure 3:
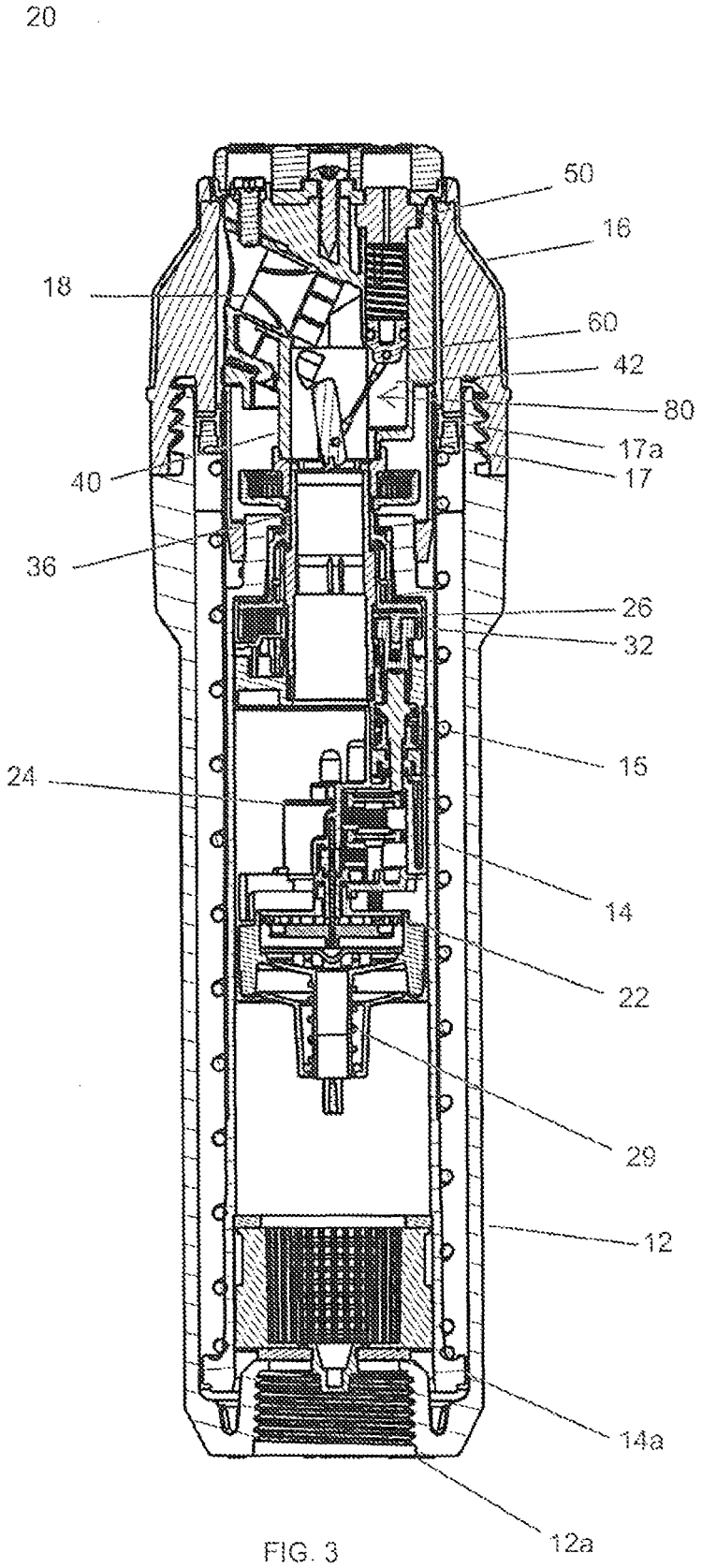
FIG. 3 is a vertical cross-sectional view of the rotor-type sprinkler of FIG. 1 illustrating its integral pressure regulator valve that is located adjacent its nozzle.
Figure 4:
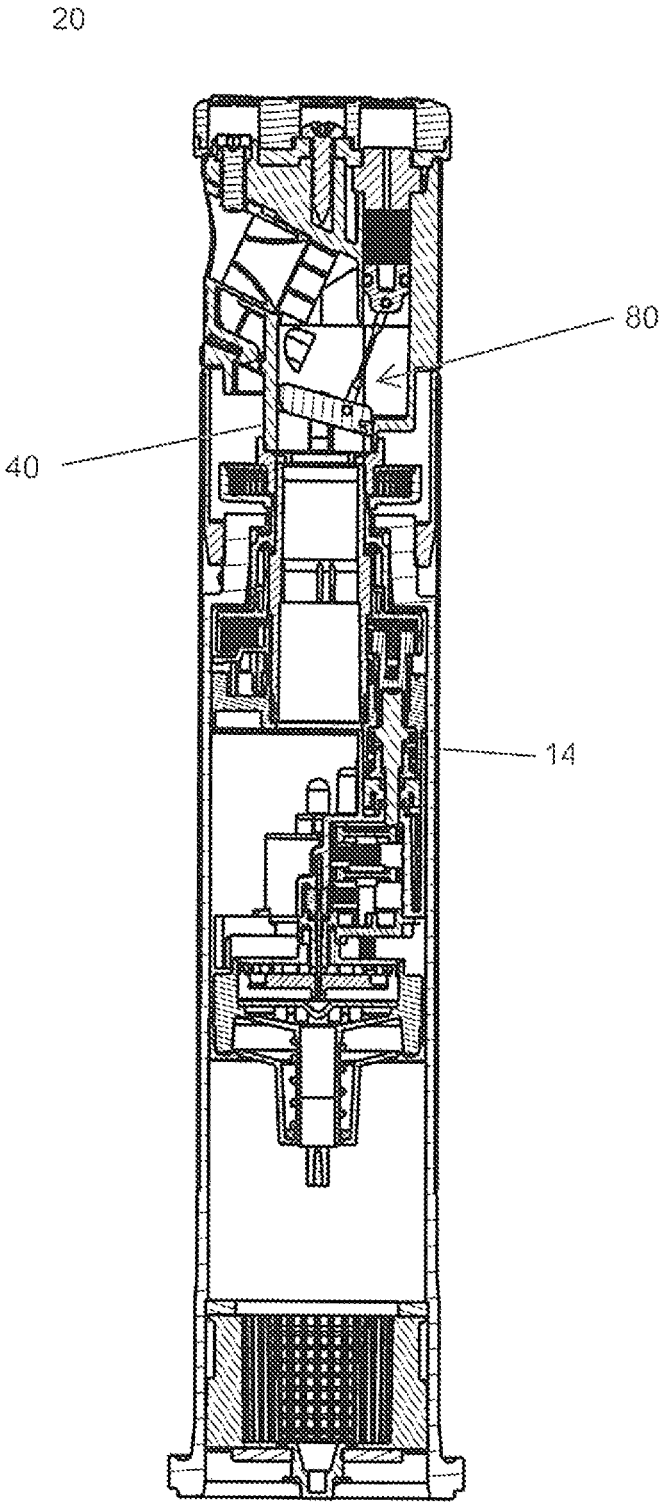
FIG. 4 is a vertical cross-sectional view of the riser portion of FIG. 2

Referring to FIG. 3, the outer case 12 has a female threaded inlet 12*a* at is lower end for screwing over a male threaded fitting (not illustrated) connected to a subterranean pipe (not illustrated) which is in turn connected to a source of pressurized water such as a solenoid-actuated valve (not illustrated). See, for example, U.S. Pat. No. 5,979,863 granted Nov. 9, 1999 to Bradley M. Lousberg and assigned to Hunter Industries, Inc., the assignee of the subject application. A ring-shaped female threaded end cap 16 is screwed over a male threaded upper end of the case 12. The lower end of a coil spring 15 seats in an upwardly opening annular groove formed in a shoulder 14*a* of the riser 14. The upper end of the coil spring 15 seats in a downwardly opening annular groove in a rigid retainer ring 17 held in place by the end cap 16. The riser 14 can telescope upwardly and downwardly through the end cap 16 to an extended position (not illustrated) when water pressure is applied at the inlet 12*a*. This compresses the coil spring 15. When the water pressure is turned OFF the force of the compressed coil spring 15 pushes the riser 14 back to its retracted position illustrated in FIGS. 1 and 3. An elastomeric ring-shaped wiper seal 17*a* surrounds the riser 14 and is positioned between the riser 14, the retainer ring 17 and the case 12.

A nozzle 18 (FIG. 3) is removably mounted in the nozzle turret 20 rotatably mounted at an upper end of the riser 14. A turbine 22 is mounted in the lower portion of the riser 14 for rotation about a vertical axis by water entering the lower end of the riser 14. The turbine 22 is mounted to the input shaft of a staggered gear train reduction 24 mounted in the riser 14. A spring-biased stator 29 is mounted in the lower portion of the riser 14 beneath the turbine 22 for controlling the rotational speed of the turbine 22.

An arc-adjustable reversing mechanism 26 (FIG. 3) is mounted in the riser 14 and operatively couples an output shaft of the gear train reduction 24 and the nozzle turret 20. The reversing mechanism 26 is one form of a coupling mechanism that optionally allows the gear train reduction 24 to adjust the mode of operation of the sprinkler 10 from the top-side thereof so that it will rotate the turret 20 back and forth between selected arc limits to provide an oscillating sprinkler or rotate the turret 20 in a continuous uni-directional manner. Other forms of the coupling mechanism can be used to rotate the nozzle turret 20 only in an oscillating manner. Another form of coupling mechanism can be used to rotate the turret 20 only in a continuous uni-directional manner. See, for example, U.S. Pat. No. 7,287,711 of John D. Cooks granted Oct. 30, 2007 and entitled "Adjustable Arc Rotor-Type Sprinkler with Selectable Uni-Directional Full Circle Nozzle Rotation" assigned to Hunter Industries. Inc., the entire disclosure of which is hereby incorporated by reference. See also the disclosures of U.S. Pat. Nos. 3,107,056; 4,568,024; 4,624,412; 4,718,605; and 4,948,052, all granted to Edwin J. Hunter, the entire disclosures of which are also hereby incorporated by reference. See also U.S. Pat. No. 7,861,948 of John D. Crooks granted Jan. 4, 2011 and entitled "Adjustable Arc Rotor-Type Sprinkler with Selectable Uni-Directional Full Circle Nozzle Rotation" assigned to Hunter Industries. Inc., the entire disclosure of which is hereby incorporated by reference.

As explained in U.S. Pat. Nos. 7,287,711 and 7,861,948, an output shaft of the gear train reduction 24 drives a set of four gears that are rotatably supported on a frame so that they can rock back and forth with the aid of an over-center spring (not illustrated). This allows the two gears on the outer ends of the frame to alternately engage the inside of a bull gear 32 (FIG. 3) to drive the same in opposite directions. The reversing mechanism 26 allows a user to set the desired size of the arc of oscillation of the nozzle 18 from the top-side of the nozzle turret 20. This is done by engaging a manual tool (not illustrated) with the slotted upper end of an arc adjustment shaft (not illustrated) that is accessible through a cross-shaped slit in the an elastomeric cover 90 (FIG. 8) affixed to the top surface of the nozzle turret 20 and twisting the shaft to change the location of a movable arc adjustment tab (not illustrated) relative to a fixed arc adjustment tab (not illustrated). Optionally maintenance personnel can convert the sprinkler 10 to a uni-directional mode in which allows full circle rotation of the nozzle 18. This is also done by manually twisting the shaft until the arc adjustment tabs overlap one another. Alternately, the reversing mechanism 26 may be built to only allow continuous rotation by not installing specific components during manufacture and assembly of the sprinkler 10 in which case the remaining components function as a non-reversing coupling mechanism between the gear train reduction 24 and the nozzle 18.

Figure 5:
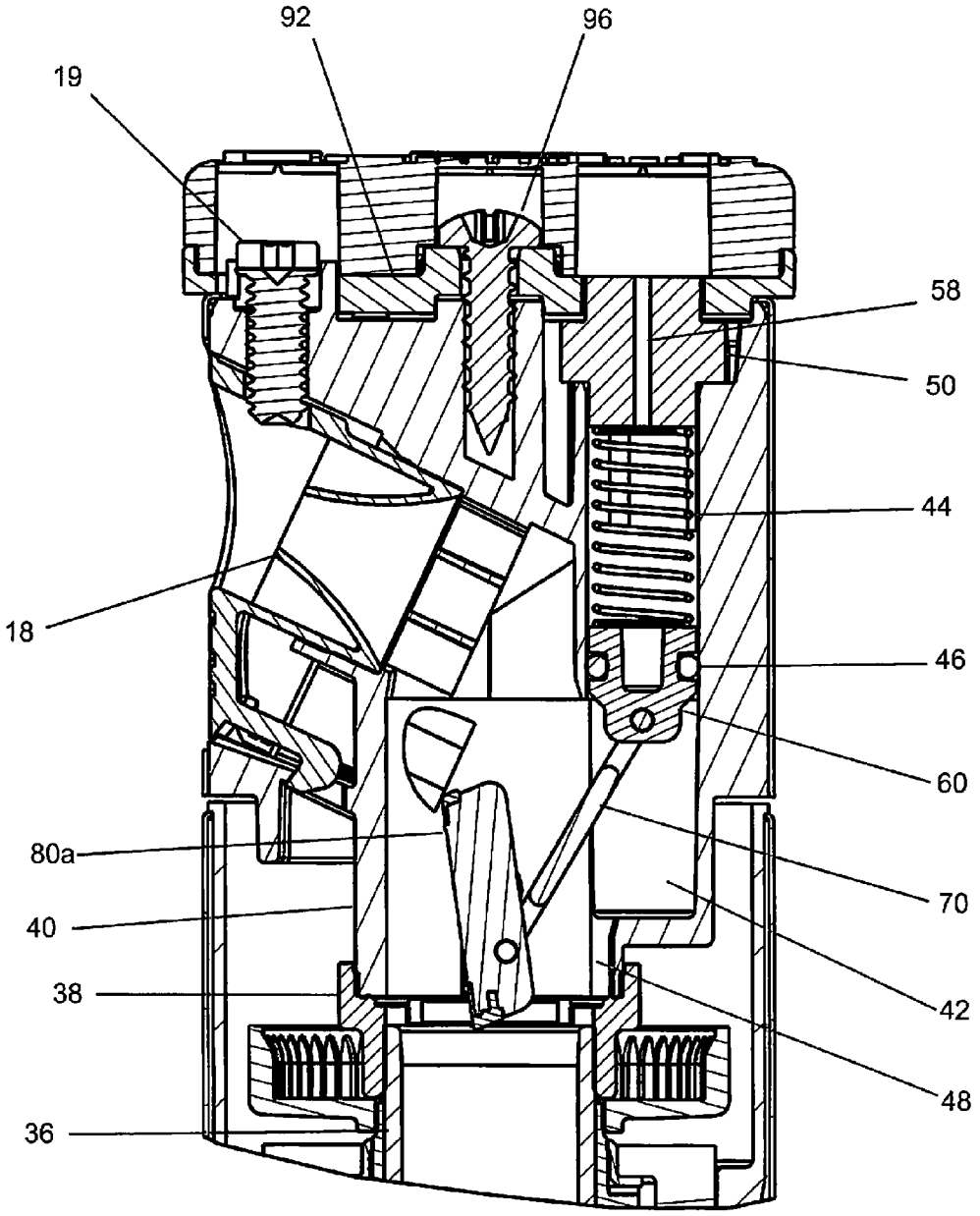
FIG. 5 is an enlarged portion of FIG. 3 illustrating details of an elliptical valve member of the pressure regulator valve in its fully open position.

A vertically extending cylindrical bull gear stem 36 (FIG. 5) is rotationally coupled in a concentric fashion with the bull gear 32 (FIG. 3) and provides a hollow tubular drive shaft that couples to the nozzle turret 20. The upper end of the bull gear stem 36 is securely coupled to the nozzle turret 20 with a cylindrical sleeve 38 (FIG. 5). The nozzle turret 20 and the nozzle 18 inserted therein are thus supported for rotation relative to the riser 14 and the case 12 by the bull gear stem 36. The upper end of the bull gear stem 36 terminates closely adjacent to the lower segment of a dog-legged tubular structure 40 formed in the nozzle turret 20. The lower vertically extending segment of the tubular structure 40 is cylindrical and centered axially in the nozzle turret 20. The nozzle 18 is inserted into the upper inclined, radially extending segment of the dog-legged tubular structure 40. The nozzle 18 is retained in position by a nozzle retention screw 19. The interior of tubular structure 40 provides a relatively large central passage that conveys water to the nozzle 18.

Figure 6:
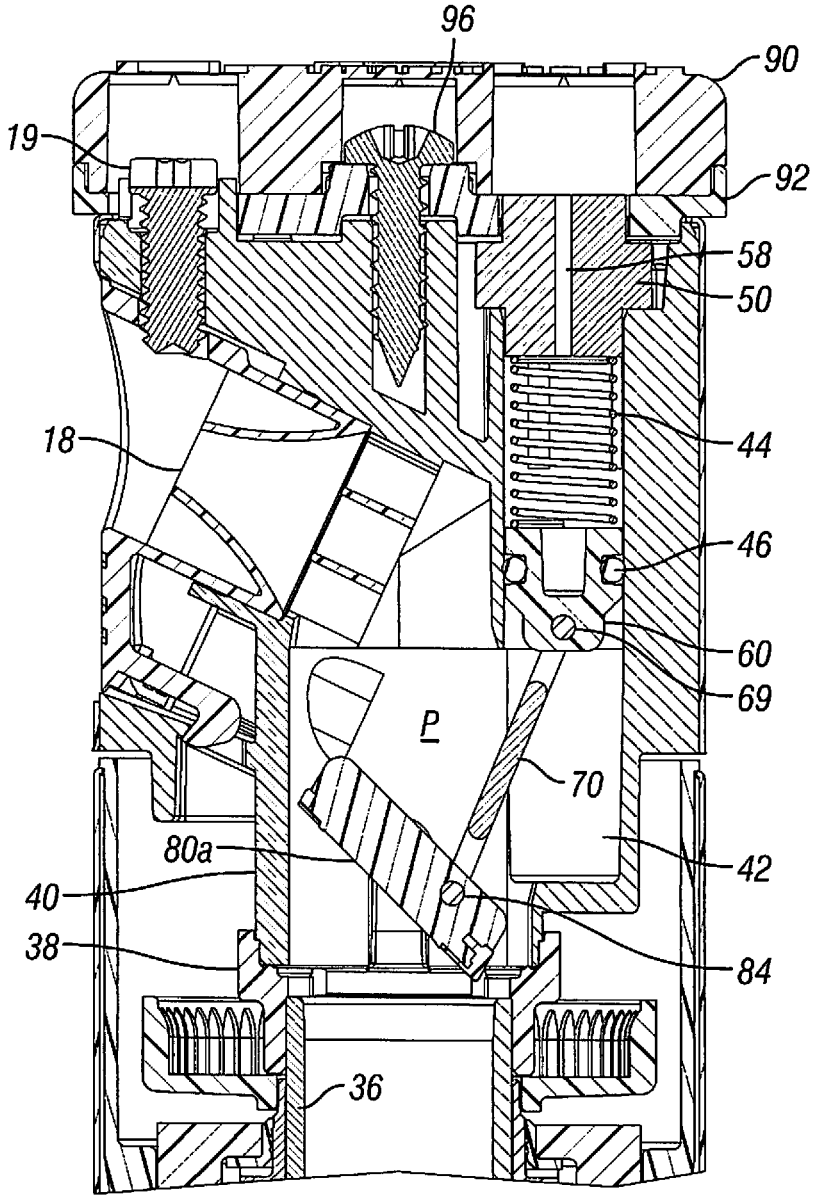
FIG. 6 is a view similar to FIG. 5 illustrating the elliptical valve member in a partially open configuration.
Figure 7:
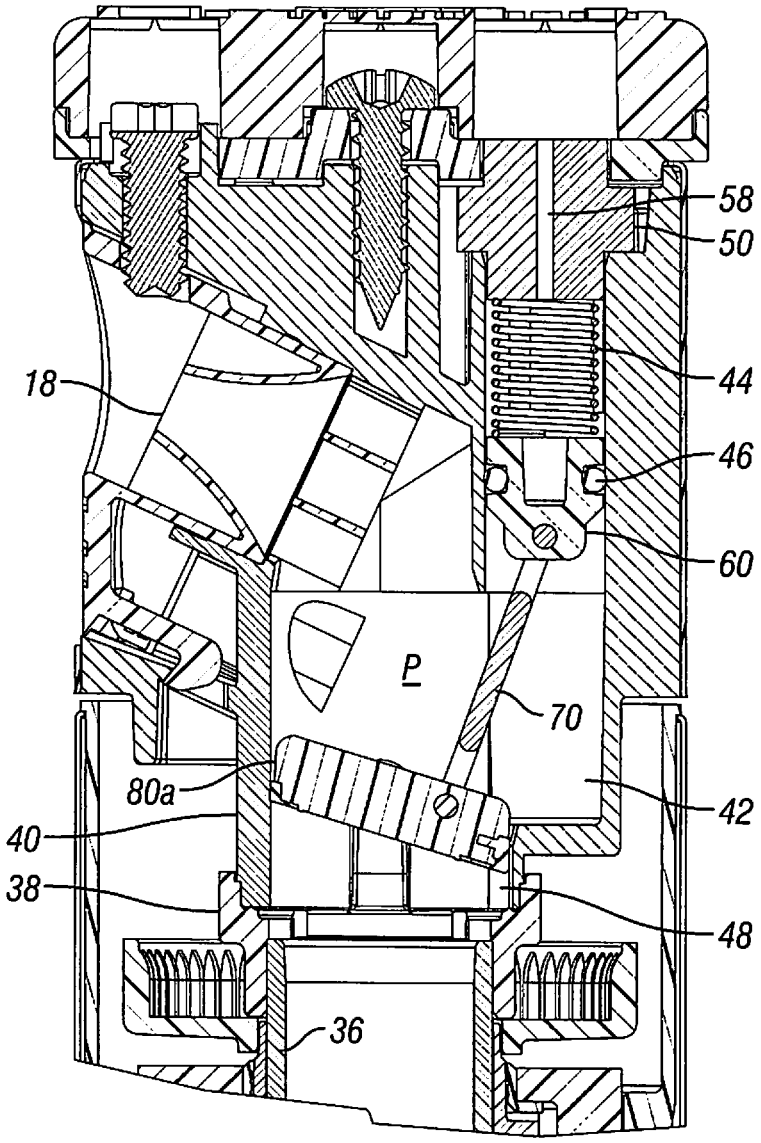
FIG. 7 is a view similar to FIG. 5 illustrating the elliptical valve member in its fully closed configuration.
Figure 8:
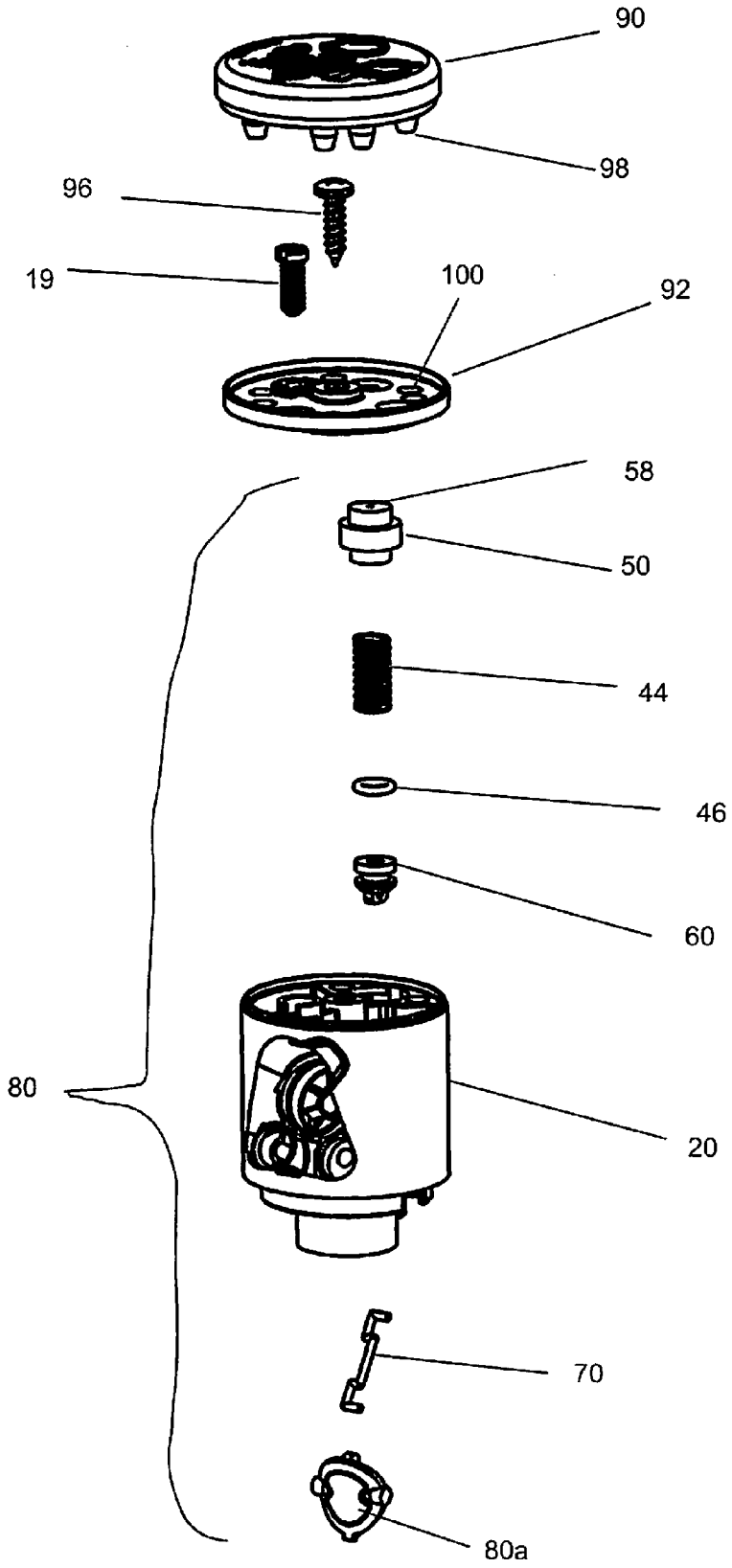
FIG. 8 is an enlarged exploded isometric view illustrating details of the individual components of the pressure regulator valve of the sprinkler of FIG. 1.
Figure 9:
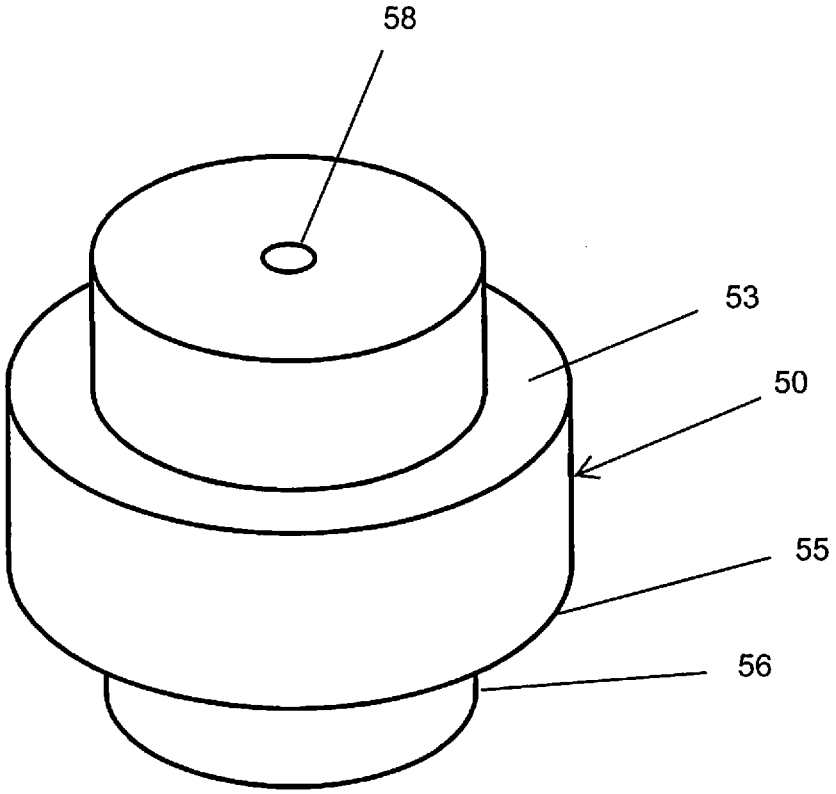
FIG. 9 is a greatly enlarged isometric view of the upper spring retainer of the pressure regulator valve of the sprinkler of FIG. 1.
Figure 11:
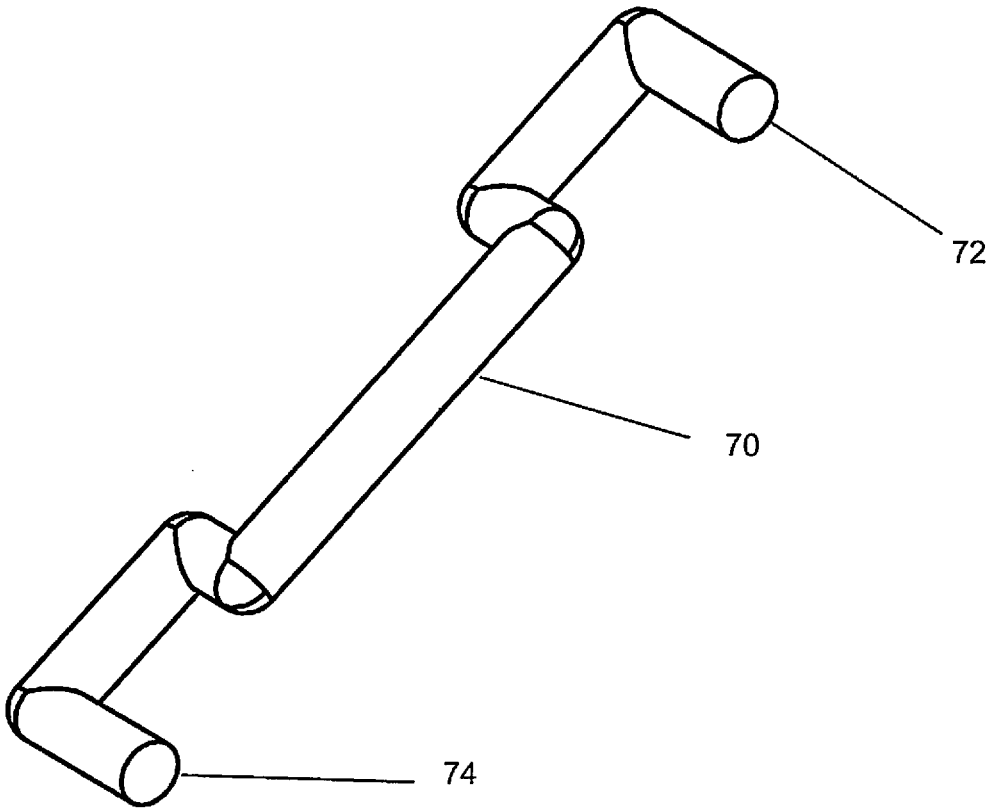
FIG. 11 is a greatly enlarged isometric view of the linkage of the pressure regulator valve of the sprinkler of FIG. 1.
Figure 12:
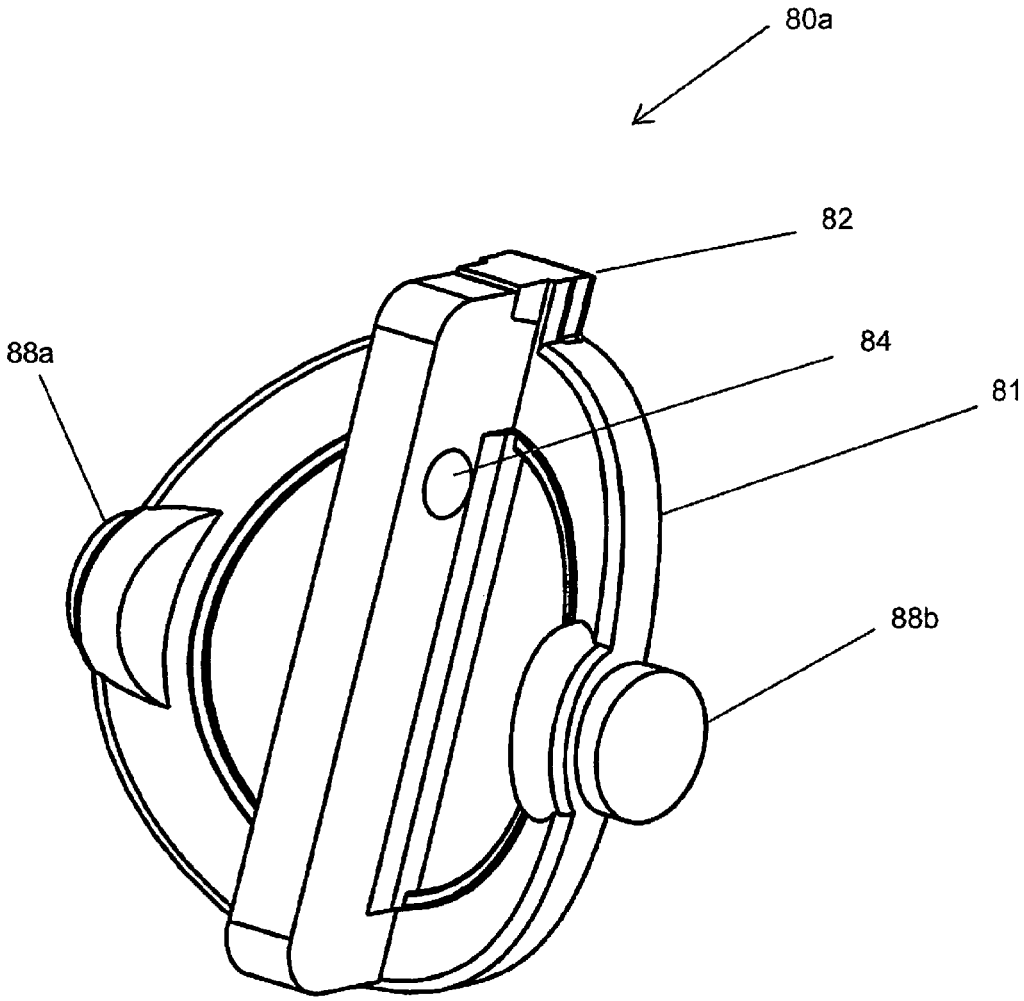
FIG. 12 is a greatly enlarged isometric view of the elliptical valve member of the pressure regulator valve of the sprinkler of FIG. 1.

A pressure regulator valve 80 (FIG. 3) includes an elliptical valve member 80*a* (FIG. 12) that is pivotably mounted between the gear train reduction and the nozzle 18. The valve member 80*a* is coupled to a piston 60 (FIG. 5) to control the pressure of water entering nozzle 18. The pressure regulator valve 80 is mounted inside the nozzle turret 20 instead of being mounted at the lower end of the riser 14 below the turbine 22 as in the aforementioned published U.S. Patent Application No. 2007/0007364 of Gregory. Referring to FIGS. 5-7, the elliptical valve member 80*a* is rotationally coupled to the lower vertically extending segment of the tubular structure 40 in the nozzle turret 20. The elliptical valve member 80*a* is rotationally connected to a linkage 70 (FIGS. 5, 8 and 11) which is in turned rotationally connected to the lower end of the piston 60. An O-ring 46 (FIG. 5) installed in groove 68 formed in the piston 60 keeps pressurized water from leaking past the piston 60. A coil spring 44 is positioned between the piston 60 and an upper spring retainer 50 (FIGS. 5, 8 and 9).

At relatively low water pressure the coil spring 44 biases the piston 60 downward and causes the elliptical valve member 80*a* to rotate to a nearly vertical fully open position illustrated in FIG. 5 that allows maximum water flow through the tubular structure 40. Somewhat higher water pressure forces piston 60 upward slightly and causes the elliptical valve member 80*a* to rotate counter-clockwise approximately forty-five degrees relative to its nearly closed position illustrated in FIG. 6. Relatively high water pressure forces the piston 60 further upward which causes the elliptical valve member 80*a* to rotate further counter-clockwise to its fully closed position illustrated in FIG. 7 where it substantially shuts off the flow of water to the nozzle 18. Complete shut off of the water flow normally only happens if the nozzle 18 is plugged, or if the tubular structure 40 is completely closed off such as by turning a manual shut-off actuator mechanism described hereafter in conjunction with FIGS. 13-24. Another example of a shut-off valve in a rotor-type sprinkler is disclosed in U.S. Pat. No. 6,241,158 granted to Michael L. Clark, et al. on Jun. 5, 2001 and entitled "Irrigation Sprinkler with Pivoting Throttle Valve," also assigned to Hunter Industries, Inc., the entire disclosure of which is hereby incorporated by reference.

Figure 10:
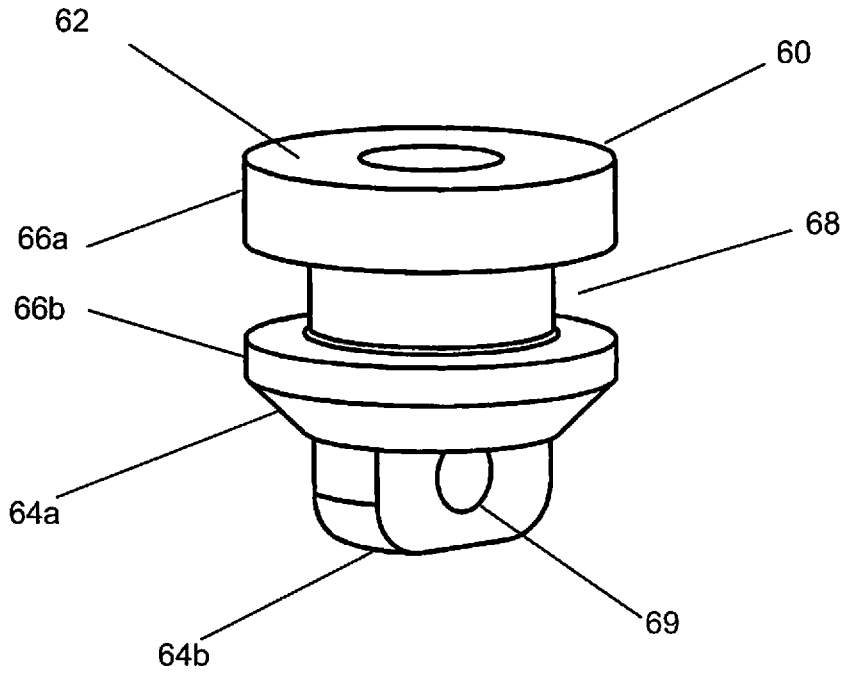
FIG. 10 is a greatly enlarged isometric view of the piston of the pressure regulator valve of the sprinkler of FIG. 1.

The interior passage P (FIGS. 6-7) of the tubular structure 40 has a round cross-section with a diameter less than the transverse diameter along the major axis of the elliptical valve member 80*a* in order to prevent the elliptical valve member 80*a* from being forced by water pressure beyond a predetermined angular orientation within the tubular structure 40. When the sprinkler 10 is delivering water through the nozzle 18 at higher pressure than is desired, the pressure will push upwards on the lower surfaces 64*a* and 64*b* (FIG. 10) of the piston 60 and cause it to move upwardly. As the piston 60 moves upwardly, the elliptical valve member 80*a* rotates and restricts more water from flowing through the interior passage P until the force of the water on the bottom of the piston 60 balances with the force of the coil spring 44 on the top of the piston 60. The force of the spring 44 is calibrated to maintain a constant pressure of water above the elliptical valve member 80*a* so that there is a constant pressure of water entering the nozzle 18 as the higher pressure in the bull gear stem 36 is reduced by the pressure regulator 80. The pressure on the top of the piston 60 is determined by the size and construction of the spring 44. The area above the piston 60 is vented to the atmosphere through a vent port 58 (FIG. 9) which is provided by a hole extending completely through the upper spring retainer 50.

As the inlet water pressure decreases, the coil spring 44 pushes the piston 60 downward causing the elliptical valve member 80*a* to rotate in a clockwise direction in FIGS. 6 and 7 to a more vertical position. This opens a larger cross-sectional area of the interior passage P. The gradual up and down movement of piston 60 thus causes the elliptical valve member 80*a* to rotate and controls the water pressure within the tubular structure 40 and at the entrance of the nozzle 18.

FIG. 8 illustrates the relationship of the components of the pressure regulator valve 80 of the sprinkler of FIG. 1 to the nozzle turret 20. All of the components of the pressure regulator valve 80 are mounted inside of the nozzle turret 20. The upper spring retainer 50 includes the vent port 58 that maintains atmospheric pressure above the piston 60. When assembled, the upper surface 53 (FIG. 9) of the spring retainer 50 is retained by a disc-shaped nozzle housing cover 92 made of a suitable elastomeric material. The nozzle housing cover 92 is secured to the nozzle turret 20 by an attachment screw 96. Lower protrusions 98 are molded into the nozzle housing cover 90 and are pressed into holes 100 on the nozzle housing cover 92 to keep the nozzle housing cover 90 securely in place.

The spring 40 surrounds the lower diameter 56 (FIG. 9) of the spring retainer 50 and seats on the lower surface 55 of the spring retainer 50. This maintains the top of the spring 44 in a fixed position during operation. The upper surface 62 (FIG. 10) of the piston 60 contacts the lower surface of the spring 44. The cylindrical outer surfaces 66*a* and 66*b* of the piston 60 maintain the piston 60 in position within a cylindrical vertical chamber 42 and create a bearing surface to guide the piston 60 as it moves within the chamber 42 of the nozzle turret 20. The O-ring 46 (FIGS. 6-8) is installed in an annular groove 68 of the piston 60 to keep pressurized water from bypassing the piston 60. A bearing bore 69 (FIG. 10) in the piston 60 accepts a journal 72 (FIG. 11) of the linkage 70. This coupling is accomplished with a slip fit so there is free rotational movement between the piston 60 and the linkage 70. A snap-fit feature (not illustrated) such as a projection may be added to the journal 72 to keep it from slipping out of the bearing bore 69 during normal operation. The journal 74 at the other end of the linkage 70 is attached in a similar fashion into a bearing bore 84 (FIG. 12) formed in the elliptical valve member 80*a*. The elliptical valve member 80*a* includes an outer sealing surface 81. The sealing surface 81 may be made of the same rigid plastic material from which the other portions of the elliptical valve member 80*a* are molded, or it may be molded out of a somewhat flexible elastomeric material that is secured to the rigid material of the main portion of the elliptical valve 80. The sealing surface 81 may be formed over the main portion of the valve member 80*a* via a co-molding process, or it may be formed separately and bonded to the main portion of the valve member 80*a* via suitable adhesive, sonic welding, heat, or other bonding technology. The sealing surface, if formed as a separate element could be attached to the main portion of the valve member 80*a* via snap-fit or tiny fasteners. A pair of trunions 88*a* and 88*b* are mounted for pivotal motion in aligned pockets (not illustrated) molded into the tubular structure 40. A seal protrusion 82 is formed in the elliptical valve member 80*a* to mate into a notch 48 (FIG. 5) formed between the tubular structure 40 and the chamber 42.

The pressure regulator valve 80 is a fixed pressure regulator in that the components thereof are configured and dimensioned to limit the water pressure at the entrance of the nozzle 18 to a predetermined desired water pressure. Achieving a predetermined water pressure at the entrance of the nozzle 18 requires that the strength of the coil spring 44 be carefully selected. A fixed pressure regulator is often specified by customers in large installations such as recreational parks, playing fields, apartment complexes and industrial parks.

Figure 13:
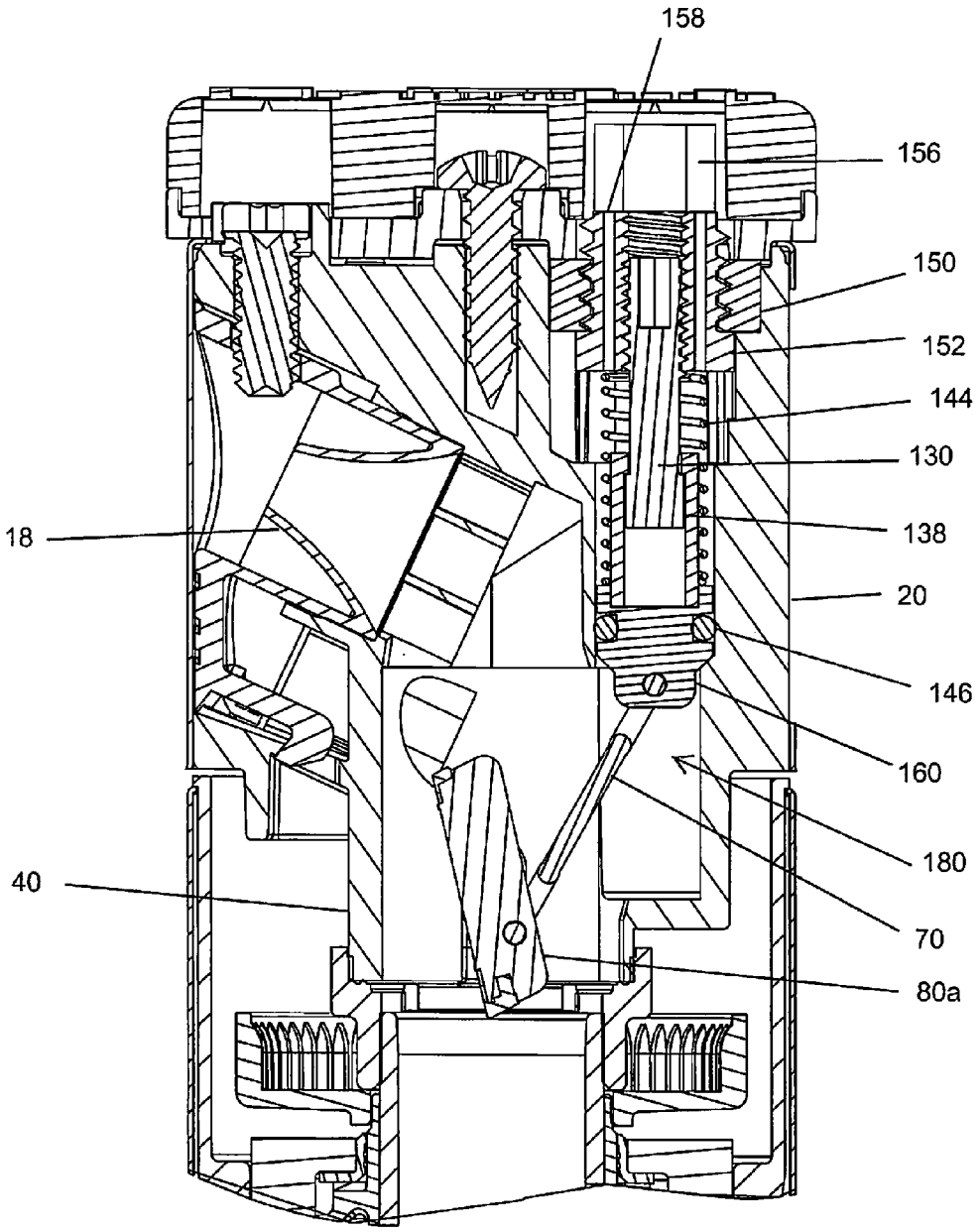
FIG. 13 is a vertical cross sectional view of a nozzle turret of a second embodiment of the present invention that includes an adjustable pressure regulator valve with a flow shut off mechanism. In this view the elliptical valve member of the pressure regulator valve is in its fully open position.
Figure 14:
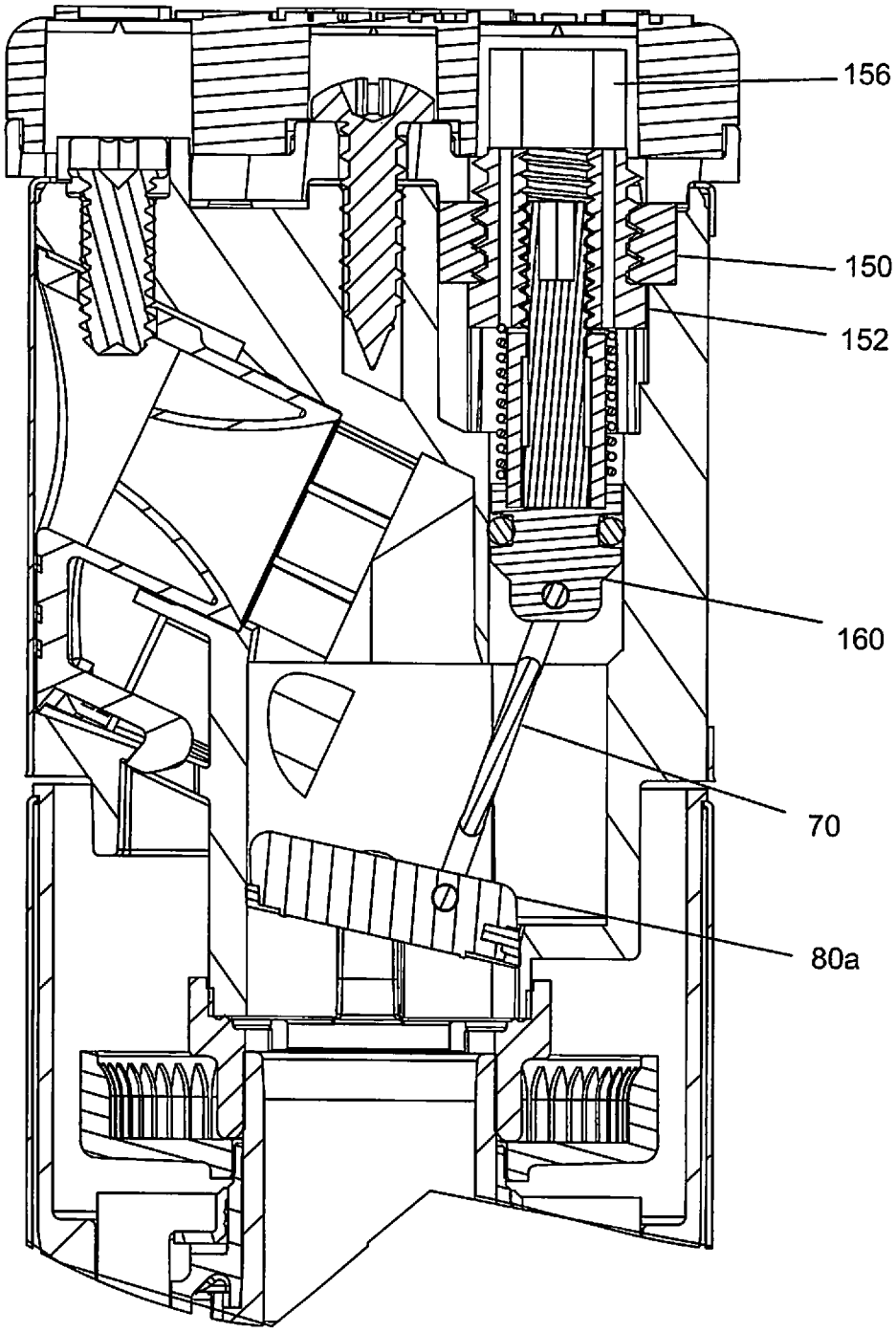
FIG. 14 is a view similar to FIG. 13 illustrating the elliptical valve member in its fully closed configuration.
Figure 15:
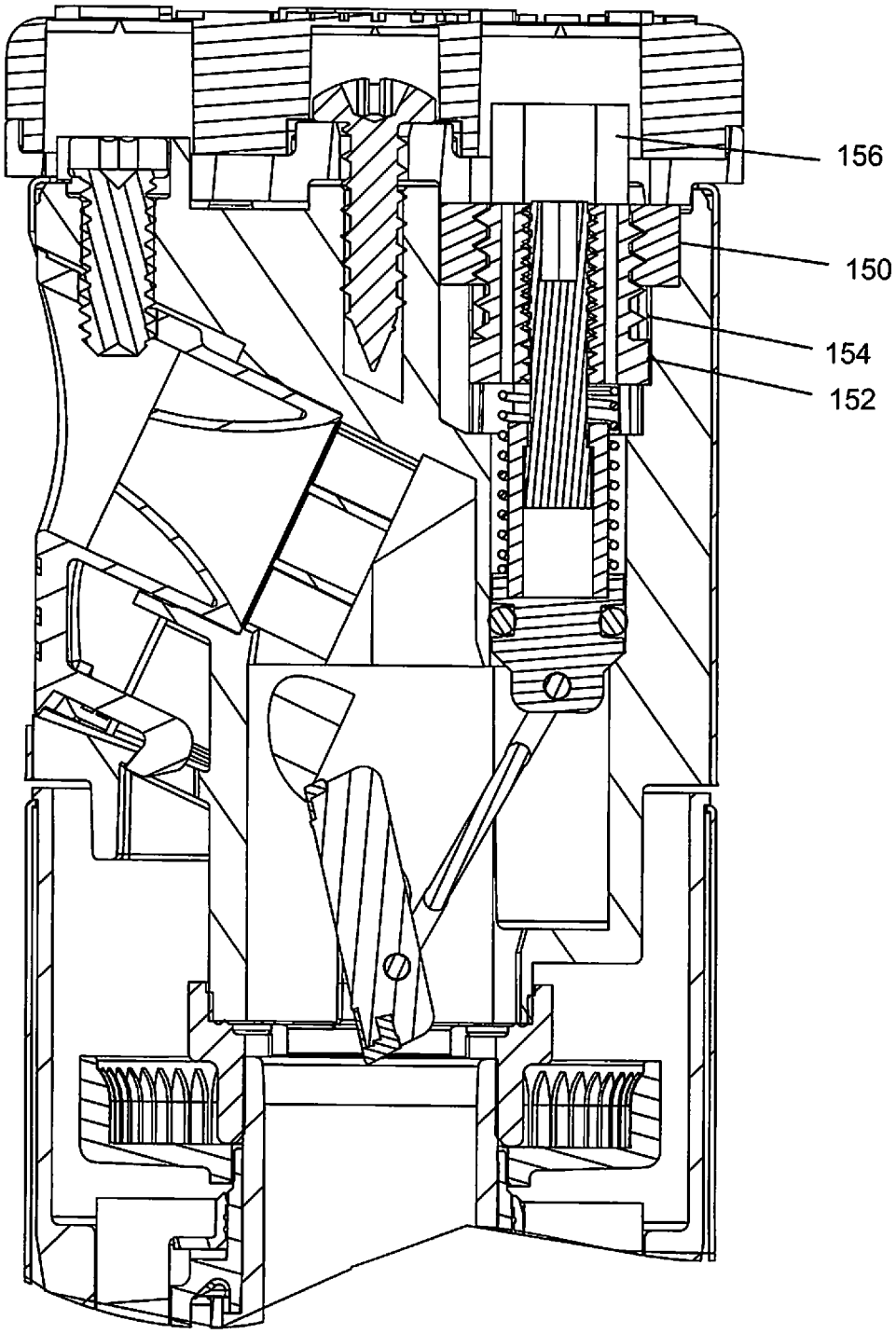
FIG. 15 is a view similar to FIG. 13 illustrating the elliptical valve member in an open configuration with the pressure adjustment set at a higher operating pressure.
Figure 19:
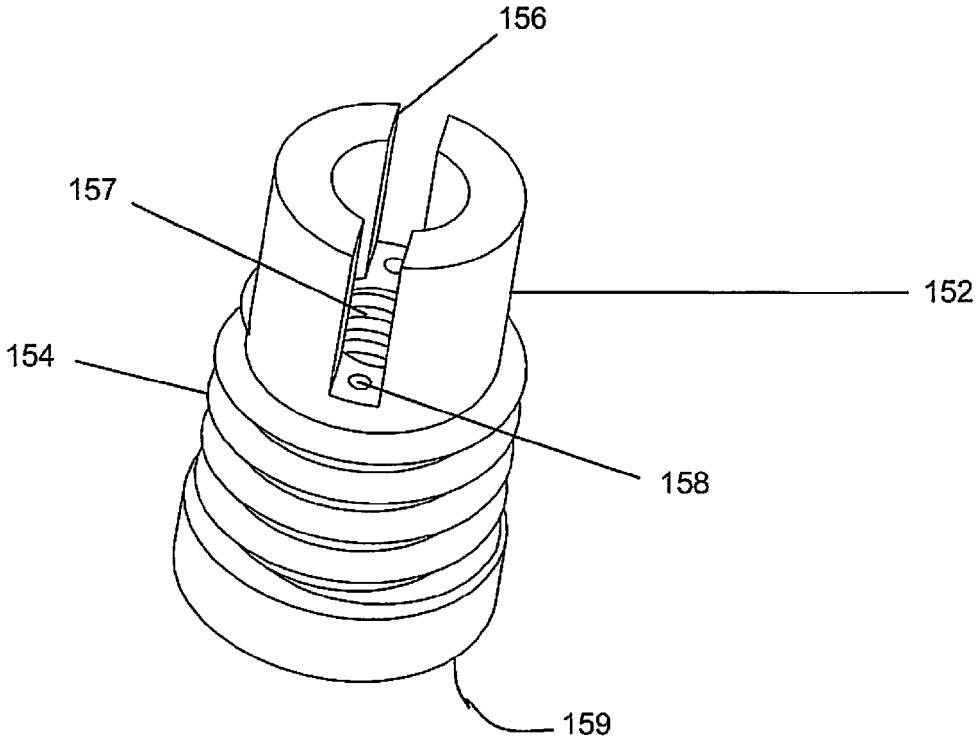
FIG. 19 is a greatly enlarged isometric view of the spring force adjusting screw of the second embodiment of FIG. 13.
Figure 20:
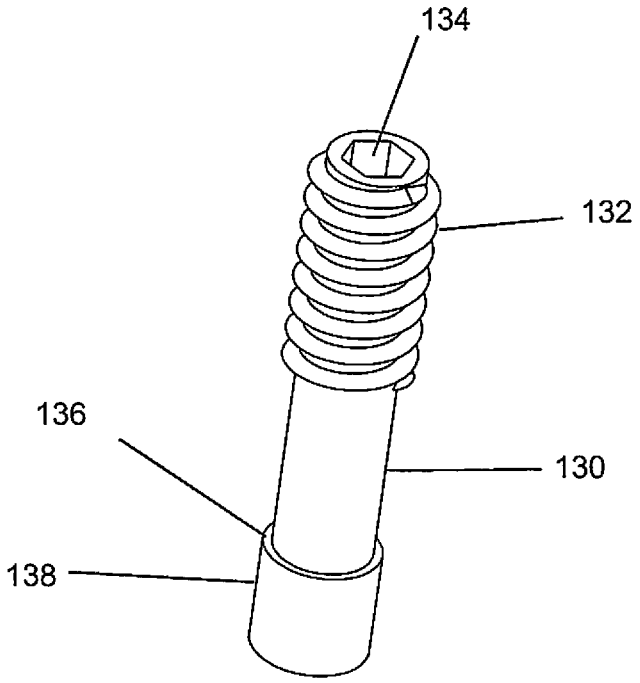
FIG. 20 is a greatly enlarged isometric view of the flow shut off actuating screw of the second embodiment of FIG. 13.
Figure 21:
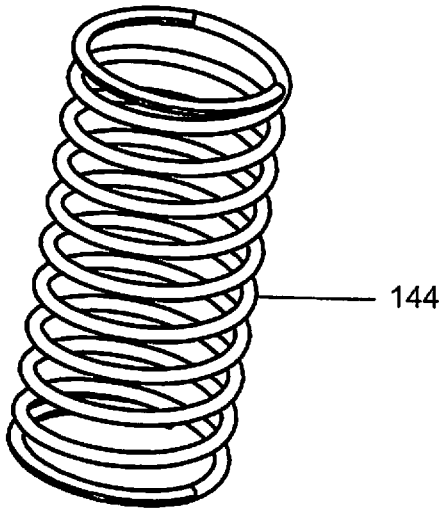
FIG. 21 is a greatly enlarged isometric view of the coil spring of the second embodiment of FIG. 13.
Figure 22:
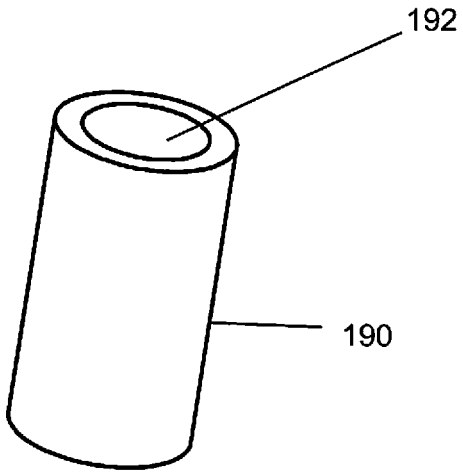
FIG. 22 is a greatly enlarged isometric view of the piston sleeve of the second embodiment of FIG. 13.
Figure 23:
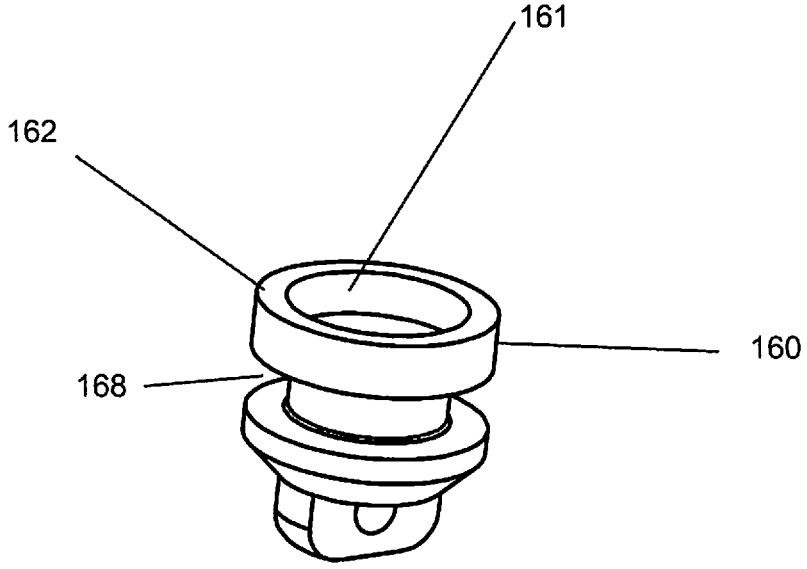
FIG. 23 is a greatly enlarged isometric view of the piston of the second embodiment of FIG. 13.

The pressure regulator valve used in a rotor-type sprinkler may be an adjustable pressure regulator. FIGS. 13-23 illustrate a second embodiment of the present invention that includes a flow shut off mechanism. An adjustable pressure regulator valve 180 (FIG. 13) includes the same valve member 80*a* that is mounted between the gear train reduction 24 and the nozzle 18. The adjustable pressure regulator valve 180 is illustrated in the same sprinkler assembly as the non-adjustable embodiment of FIGS. 1-12. The adjustable pressure regulator valve 180 includes the pivotably mounted elliptical valve member 80*a* that is coupled to a piston 160 to control the pressure of water entering the nozzle 18. The adjustable pressure regulator valve 180 is mounted inside the nozzle turret 20 just as in the non-adjustable version of the pressure regulator valve 80 of the embodiment of FIGS. 1-12. Referring to FIGS. 13-16, the elliptical valve member 80*a* is rotationally coupled to the lower vertically extending segment of the tubular structure 40 in the nozzle turret 20 via trunions 88*a* and 88*b*. The elliptical valve member 80*a* is rotationally connected to a linkage 70 which is in turn rotationally connected to the lower end of the piston 160. An O-ring 146 (FIG. 17) installed in groove 168 formed in the piston 160 keeps pressurized water from leaking past the piston 160. An upper retainer 150 is non-rotationally mounted in a mating cavity in nozzle turret 20. A spring force adjusting screw 152 is threaded into the threads 151 of the upper retainer 150. Slot 156 is provided to allow a user to rotate the spring force adjusting screw with a tool. A coil spring 144 is positioned between the piston 160 and the lower surface 159 of the spring force adjusting screw 152 (FIGS. 13, and 19). As threads 154 of the spring force adjusting screw rotate within threads 151 of the upper retainer 150 (FIG. 18), the spring force adjusting screw 152 raises or lowers in the turret 20 to decrease or increase the pressure on spring 144 relative to the position of the elliptical valve member 80*a*. Lowering the spring force adjusting screw 152 increases the pressure range of the adjustable pressure regulator valve 180. Raising the spring force adjusting screw 152 decreases the pressure range of the adjustable pressure regulator valve 180. FIG. 13 illustrates the spring force adjusting screw in a raised position to cause a lower regulating pressure. FIG. 15 illustrates the spring force adjusting screw 152 in a lowered position to cause a higher regulating pressure.

Figure 16:
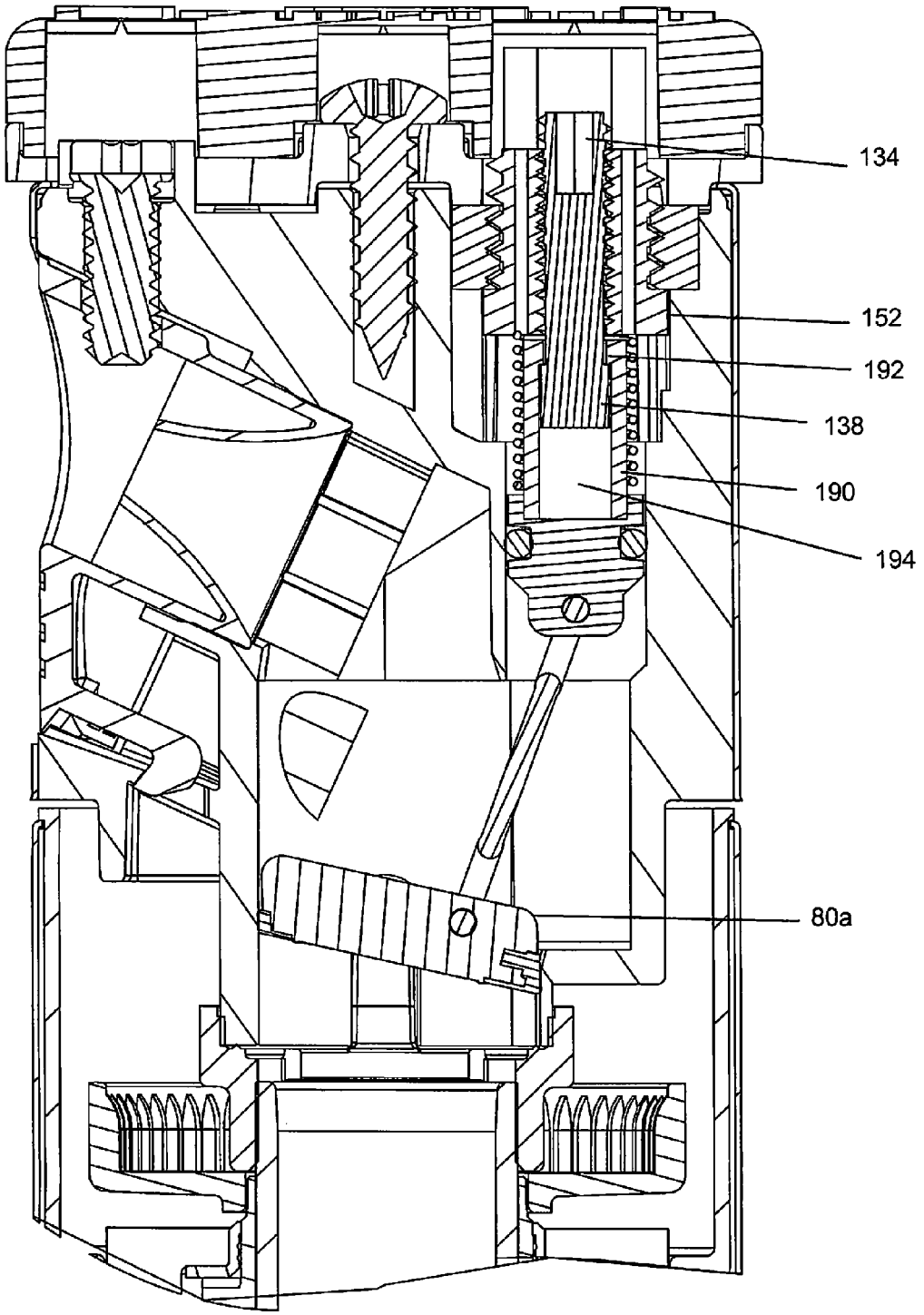
FIG. 16 is a view similar to FIG. 13 illustrating its manual shut off mechanism adjusted so that the elliptical valve member in its fully closed configuration.
Figure 17:
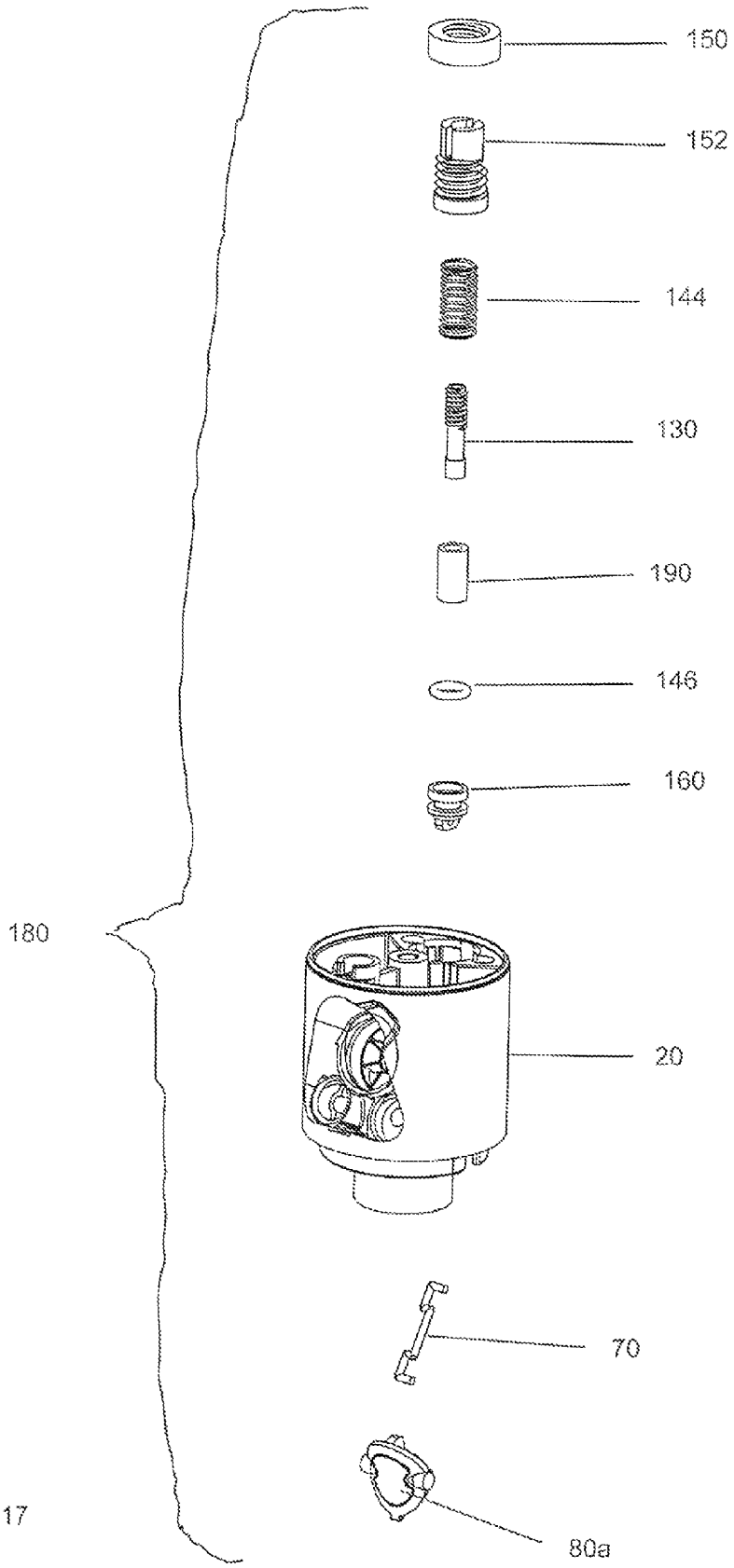
FIG. 17 is an enlarged exploded isometric view illustrating details of the individual components of the second embodiment of FIG. 13.
Figure 18:
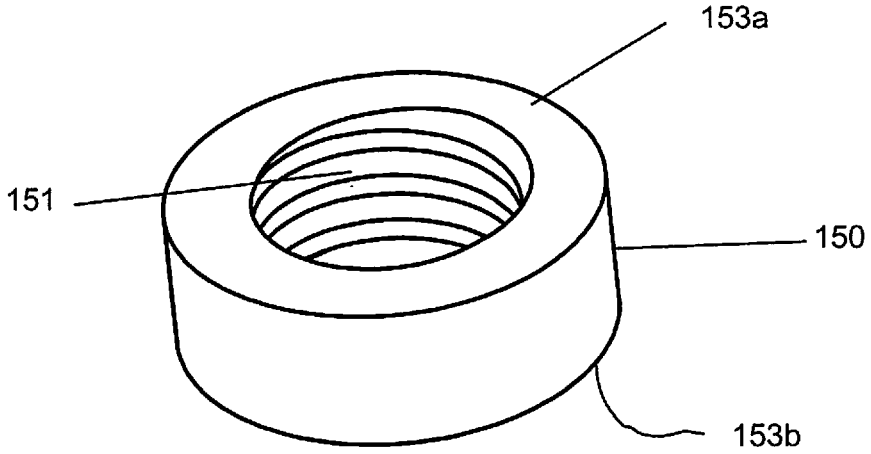
FIG. 18 is a greatly enlarged isometric view of the upper retainer of the second embodiment of FIG. 13.

The embodiment of FIGS. 13-23 includes a flow shut off mechanism. For the flow shut off mechanism to operate, female threads 157 (FIG. 19) are formed in the interior body of the spring force adjusting screw 152. Complementary male threads 132 are formed on the exterior of the flow shut off actuating screw 130. The larger head 138 is installed in the lower cavity 194 of cylinder 190. The larger head 138 is sized to slide freely in the larger bore 194, but is too large to enter the smaller bore 192 of the cylinder 190. Cylinder 190 is permanently secured to the piston 160 by bonding it into the cavity 161 of the piston 160. FIG. 16 illustrates the flow shut off actuating screw 130 adjusted to turn OFF the flow of water to the nozzle 18. To accomplish the flow shut off, an operator inserts a tool into hexagonal socket 134 (FIG. 19) of the flow shut off actuation screw 130 and rotates it counter-clockwise. When doing this, the portion of the screw 130 with the male threads 132 rotates within the portion of the adjusting screw 152 with the female threads 157. This action causes the flow shut off actuation screw 130 to rise. The larger head 138 rises to the upper limits of bore 192 and forces the piston 160 to raise, and rotate the valve member 80*a* to its fully closed position. Turning the flow shut off actuation screw 130 in the opposite direction allows the valve 60 to move freely in relation to the flow shut off adjusting screw 130 and resume its ability to move in response to the forces of water pressure and the spring 44 and cause the valve member 80*a* to be positioned appropriately to regulate the pressure of the water entering the nozzle 18. Once the adjustable pressures regulator valve 180 is set to its desired pressure, the operation of the adjustable pressure regulator valve 180 is the same as the fixed pressure regulator 80.

Figure 24:
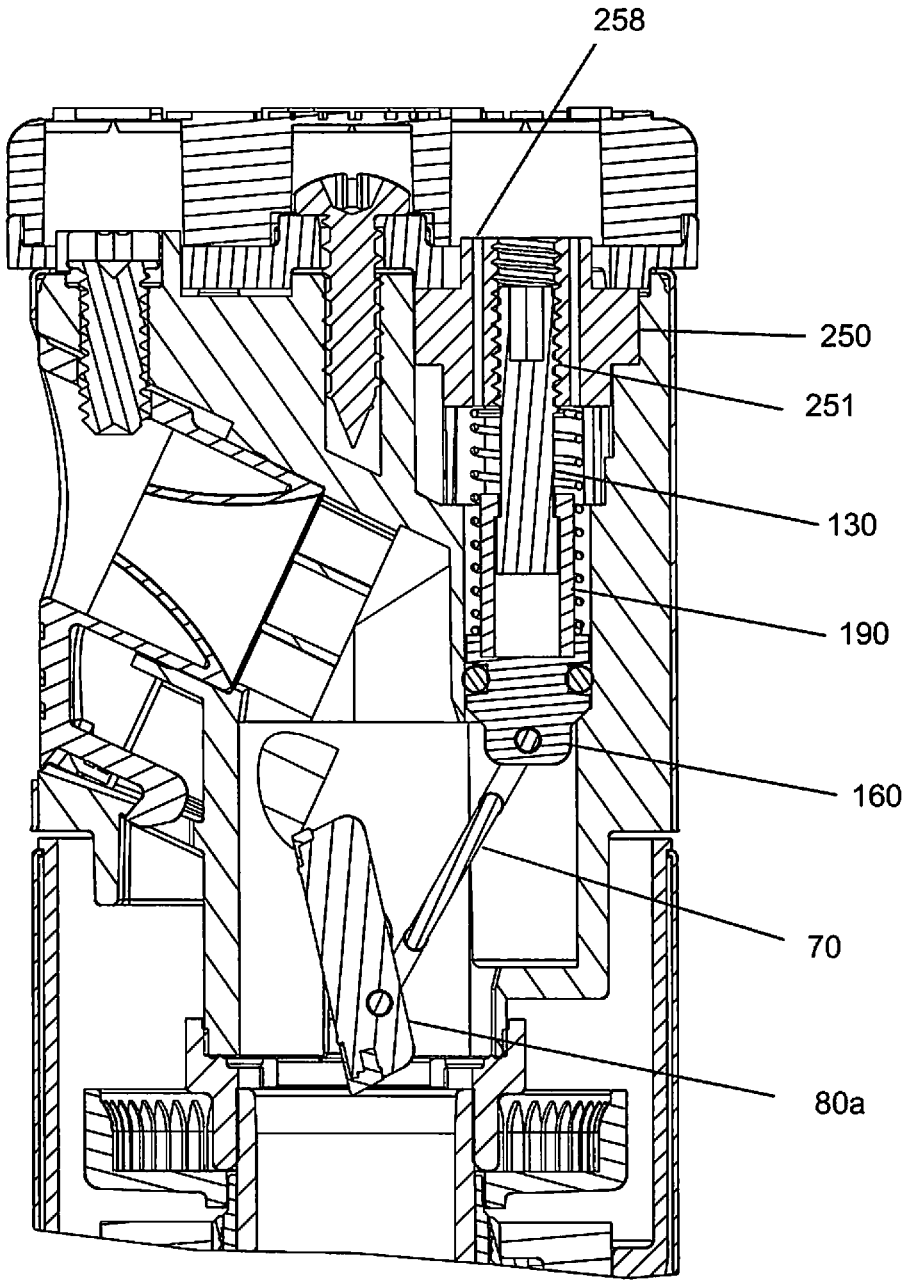
FIG. 24 is a vertical cross section of a nozzle turret of a third embodiment of the present invention that includes a fixed pressure regulator with a flow shut off mechanism and an elliptical valve member in its fully open position.

FIG. 24 illustrates a third embodiment of the present invention that includes a flow shut off mechanism with a non-adjustable pressure regulator. FIG. 24 illustrates the elliptical valve 80*a* in an open, full flow position. The structure and operation of the flow shut off mechanism illustrated in FIG. 24 is the same as described above, except that the regulator adjusting components 150 and 152 are replaced with a single threaded non-adjustable upper spring retainer 250. Upper spring retainer 250 includes at least one vent port 258 and a female threaded portion 251 to accept the male threaded portion 132 of the flow stop actuator 130.

Regulating the water pressure adjacent the nozzle 18 results in substantial water savings. The incorporation of the fixed pressure regulator valve 80 or the adjustable pressure regulator valve 180 into the rotor-type sprinkler 10 ensures that the desired amount of water in terms of gallons per hour is distributed onto turf and landscaping by the sprinkler 10 regardless of fluctuations, within a nominal range, in the pressure of the water supplied at the female threaded inlet 12*a*. The pressure of the water supplied by a municipality can vary, for example, from thirty PSI to over one hundred PSI. Where the water is pumped from a well, there may also be pressure fluctuations. In addition, the water pressure encountered by the sprinkler 10 can vary depending upon how many sprinklers are attached to a given pipe and how far away from the valve the sprinkler 10 is connected, and how many sprinklers are connected to the branch pipe upstream from the sprinkler 10. Moreover, the water pressure at the entrance to the sprinkler 10 can vary depending on the grade of the landscape site where the sprinkler is installed. If the pipe rises in elevation to the location where the sprinkler 10 is connected, the water pressure at the sprinkler 10 will be lower than it would if the sprinkler 10 were connected to the pipe at a lower elevation.

Rotor-type sprinklers that have heretofore included a pressure regulator have located the pressure regulator below the turbine 22, adjacent to the inlet at the lower end of the riser 14. Rotor-type sprinklers have many internal mechanisms inside their risers and water must flow past many of these mechanisms. Therefore, if the pressure is regulated near the lower end of the riser 14 of the sprinkler 10 it is difficult to precisely control the pressure at the nozzle 18. The present invention places the fixed pressure regulator valve 80 or the adjustable pressure regulator valve 180 closely adjacent the nozzle 18. By placing the valve member 80*a* between the gear train reduction 24 and the nozzle 18 the water pressure is accurately regulated at this critical location, because the flow rate through the nozzle 18 is dependent upon the water pressure at the entrance to the nozzle 18. The size of the orifice in the nozzle 18 is carefully sized and configured to produce the desired flow rate in terms of gallons per hour. See U.S. Pat. No. 5,456,411 granted Oct. 10, 1995 to Loren W. Scott et al., U.S. Pat. No. 5,699,962 granted Dec. 23, 1997 to Loren W. Scott et al. and U.S. Pat. No. 6,871,795 granted to Ronald H. Anuskiewicz on Mar. 29, 2005, the entire disclosures of which is hereby incorporated by reference. The aforementioned patents are also assigned to Hunter Industries, Inc.

Because the pressure regulating elliptical valve member 80*a* is closely adjacent to the nozzle 18 there is no pressure reduction that would otherwise occur if a pressure regulator were located adjacent the inlet end of the riser 14. If a pressure regulator is located in the lower end of the riser 14 or in the case 12 adjacent the inlet 12*a* the water thereafter encounters resistance as it flows past the turbine, gears, reversing mechanisms and other components inside the riser 14. Thus the present invention advantageously reduces the water pressure in the vicinity of the inlet of the nozzle 18. High water pressure can be applied at the inlet 12*a* of the case 12 to drive the turbine 22 with a lower pressure resulting at the entrance of the nozzle 18. The present invention also reduces the cost of providing a pressure regulated rotor-type sprinkler compared to the cost of building the pressure regulator into the lower end of the riser 14 adjacent the inlet 12*a* or attaching a separate pressure regulator near the inlet 12*a* but externally of the sprinkler. In addition, the present invention reduces the overall height otherwise required to provide a rotor-type sprinkler with an internal pressure regulator. For example, the height of the sprinkler 10 may be only four inches compared to a height of six inches if a pressure regulator were incorporated into the lower end of the riser 14 or in the case 12 adjacent the inlet 12*a*, or if a pressure regulator were installed externally, directly beneath the sprinkler.

While I have disclosed embodiments of a rotor-type sprinkler with a built-in pressure regulator adjacent its nozzle, it will be understood by those skilled in the art that my invention can be modified in both arrangement and detail. For example, instead of the staggered gear train reduction 24 the sprinkler 10 could incorporate a planetary gear train reduction. Other forms of reversing mechanism could be used such as a plate with tangential fluid ports and a port shifting mechanism, or a combination planetary gear reduction and reversing mechanism such as that disclosed in U.S. Pat. No. 7,677,469 of Michael L. Clark, and pending U.S. patent application Ser. Nos. 12/710,298 of Michael L. Clark et. al., and 12/710,265 of Michael L. Clark et. al., all of which are also assigned to Hunter Industries, Inc., the entire disclosures of which are hereby incorporated by reference. The notched area 48 may not be required such that the elliptical valve member 80*a* may not require the additional sealing feature 82. The circumference of the valve member 80*a* could be round. There could be a step formed in the tubular structure 40 to keep the round valve member from being forced past a certain angular position. Therefore the protection afforded the present invention should only be limited in accordance with the following claims.

What is claimed is:

1. An irrigation sprinkler, comprising: a riser; a nozzle rotatably mounted at an upper end of the riser; a turbine mounted in the riser and rotatable by water entering a lower end of the riser; a gear train reduction mounted in the riser; a coupling mechanism mounted in the riser and coupling the gear train reduction and the nozzle; and a pressure regulator valve incorporating: a valve member pivotably mounted in a fluid flow path between the turbine and the nozzle to regulate fluid pressure in the fluid flow path, the valve member configured to pivot about a midpoint of the valve member in response to fluctuations in a first fluid pressure to restrict flow through the valve member and maintain the flow exiting the valve member to a relatively constant second fluid pressure; and a spring mounted to bias the valve member toward a position.

2. The sprinkler of claim 1 wherein the pressure regulator is mounted within a nozzle turret that is rotatably mounted at the upper end of the riser and supports the nozzle.

3. The sprinkler of claim 1 and further comprising a flow shut off mechanism that can be manually actuated to move the valve member to a closed position.

4. The sprinkler of claim 1 wherein the coupling mechanism includes a reversing mechanism that can be adjusted so that the nozzle rotates between a pair of selected arc limits.

5. The sprinkler of claim 1 wherein the valve member has an elliptical configuration.

6. The sprinkler of claim 1 wherein the pressure regulator valve includes a piston operatively coupled to the valve member.

7. The sprinkler of claim 6 wherein the spring that is mounted to bias the valve member toward a position is a coil spring.

8. The sprinkler of claim 1 wherein the valve member includes an outer sealing surface made of an elastomeric material.

9. The sprinkler of claim 6 and further comprising a linkage for operatively coupling the valve member and the piston.

10. The sprinkler of claim 6 and further comprising a seal surrounding the piston to substantially prevent the passage of pressurized water.

11. An irrigation sprinkler, comprising: a riser; a nozzle rotatably mounted at an upper end of the riser; a turbine mounted in the riser and rotatable by water entering a lower end of the riser; a gear train reduction mounted in the riser; a coupling mechanism mounted in the riser and coupling the gear train reduction and the nozzle; and an adjustable pressure regulator valve incorporating a valve member pivotably mounted between the gear train reduction and the nozzle to maintain a relatively constant pressure of the water at an entrance to the nozzle when the water pressure entering the sprinkler is above a predetermined level; wherein the adjustable regulator includes a piston reciprocable in a cylinder, a spring that biases the piston to a predetermined position, and a linkage that connects the piston and the valve member, the piston reciprocates within the cylinder in response to a change in pressure of the water acting on a lower face of the piston, wherein the water pressure causes the piston to direct the movement of the valve.

12. The sprinkler of claim 11 wherein the adjustable regulator further includes a spring force adjusting screw that can be turned to adjust a force that the spring applies to the piston.

13. The sprinkler of claim 11 and further comprising a flow shut off mechanism that can be manually actuated to move the valve member to a closed position.

14. The sprinkler of claim 13 wherein the flow shut off mechanism includes a flow shut off actuating screw.

15. The sprinkler of claim 1 wherein the pressure regulator valve further includes a piston mounted in the nozzle turret for reciprocation in response to variations in the fluid pressure.

16. The sprinkler of claim 15 wherein the pressure regulator valve further includes a linkage operatively coupling the piston and the valve member.

17. The sprinkler of claim 11 wherein the valve member has an elliptical configuration.

18. The sprinkler of claim 15 wherein the spring is mounted in the nozzle and engages the piston to bias the valve member toward a fully open position.

* * * * *

UNITED STATES PATENT AND TRADEMARK OFFICE

CERTIFICATE OF CORRECTION

PATENT NO. : 8,636,233 B2
APPLICATION NO. : 13/051255
DATED : January 28, 2014
INVENTOR(S) : Clark et al.

It is certified that error appears in the above-identified patent and that said Letters Patent is hereby corrected as shown below:

On the Title Page, Item (54), and in the Specification, column 1 at lines 1-3, Title, Change "LOW PRECIPITATION RATE ROTOR-TYPE SPRINKLER WITH INTERMITTENT STREAM DIFFUSERS" to --ROTOR-TYPE SPRINKLER WITH PRESSURE REGULATOR VALVE MEMBER ADJACENT NOZZLE--.

In the Claims

In column 10 at line 31, In Claim 15, after "nozzle" delete "turret".

Signed and Sealed this
Thirtieth Day of September, 2014

Michelle K. Lee

Michelle K. Lee
*Deputy Director of the United States Patent and Trademark Office*